United States Patent [19]

Kadowaki

[11] 3,951,309

[45] Apr. 20, 1976

[54] DEVICE FOR DETECTING THE QUANTITY OF REMAINING DEVELOPER

[75] Inventor: Syujiro Kadowaki, Yokohama, Japan

[73] Assignee: Canon Kabushiki Kaisha, Tokyo, Japan

[22] Filed: July 8, 1974

[21] Appl. No.: 486,317

[30] Foreign Application Priority Data

July 11, 1973 Japan ..... 48-82501[U]

[52] U.S. Cl. ..... 222/64; 200/61.20; 222/160; 222/DIG. 1; 335/205

[51] Int. Cl.[2] ..... B65D 83/06

[58] Field of Search ..... 222/64–66, 222/160, DIG. 1, 410; 118/7, 10; 221/14; 200/61.20, 61.21; 335/205, 206, 207

[56] References Cited

UNITED STATES PATENTS

| | | | |
|---|---|---|---|
| 1,892,790 | 1/1933 | Smelser | 222/66 X |
| 2,555,513 | 6/1951 | Schweitzer | 335/205 |
| 2,612,299 | 9/1952 | McCabe | 222/410 |

*Primary Examiner*—Robert B. Reeves
*Assistant Examiner*—John P. Shannon
*Attorney, Agent, or Firm*—Fitzpatrick, Cella, Harper & Scinto

[57] ABSTRACT

A device for detecting the quantity of remaining developer comprises a non-magnetic container for magnetic developer formed with a lower discharge port, a magnet disposed outside and adjacent the bottom of the container for producing a magnetic attraction between the magnet and the magnetism of the developer within the container, a rotary screw roller or a rotary impeller for delivering the developer from the container through the discharge port thereof, a mechanism for causing relative movement of the magnet and the container away from each other against the magnetic attraction when the developer is below a predetermined quantity, and a switch operable by such relative movement.

5 Claims, 5 Drawing Figures

DEVICE FOR DETECTING THE QUANTITY OF REMAINING DEVELOPER

BACKGROUND OF THE INVENTION

1. Field of the Invention

This invention generally relates to a device for detecting the quantity of remaining developer which is for application in the dry type developing device of an electrophotographic copying machine. More particularly, it relates to an improved dry type developing device which can accurately detect when the developer in the developer tank or developing means of such developing device is below a predetermined quantity.

2. Description of the Prior Art

In electrophotographic copying machines of the dry development type, development is usually effected by the use of powdered developer after an electrostatic latent image is formed on a photosensitive medium. The dry type developing devices include those which adopt various types of means such as magnetic brush, cascade, fur brush, powder cloud, etc. and in any of these, the powdered developer is supplied from a hopper-like developer tank into developing means, as required. Such developer tank may assume various configurations such as; an open-bottomed tank having a concave-convex surfaced rotary roller provided in the bottom opening thereof for causing the powdered developer to be dropped for supply by the rotation of the roller; an open-bottomed tank having a rotary screw roller provided in the bottom thereof for delivering the powdered developer by the axial thrust imparted by the rotation of the screw roller; or an open-bottomed tank having a member provided in the bottom opening thereof for causing the powdered developer to be dropped for supply by the reciprocal movement of the bottom member. In these developer tanks, it is important in producing stable copy images that, when the powdered developer continues to decrease in quantity from full condition to deficient condition, such deficient condition be detected to provide a fresh supply of developer or to stop the machine from operating. The present invention intends to provide a device which can accurately, reliably and simply detect a point of time at which such deficiency of the developer occurs.

In the electrophotographic copying machines of the liquid development type, detection of the quantity of remaining developing liquid could readily and accurately and reliably be accomplished by using a float or like means to detect the level of the liquid, or by using a transparent tank to effect the detection by the varying quantity of light passed through the developing liquid in the tank. However, these detection methods are not available for the developer tanks containing powdered developer therewithin, because such developer tends to deposit on the tank wall to intercept the passage of light therethrough and thus make the detection impossible or because the powdered developer does not aways decrease its quantity uniformly within the tank but rather the quantity of the developer depositing on the tank wall does not decrease during development, thus making it impossible to use a float or the like for the purpose of detecting the remaining quantity. Thus; in the dry type electrophotographic copying machines, there has been developed no device for detecting the quantity or remaining developer, which device is low in cost and accurate, reliable and stable in operation.

Besides liquid developer detectors, there are som devices which utilize variations in impedance between an electrode provided in the supply container and the wall of such container or which utilize variations in resistance of a rotary impeller installed within the supply container, but none of these devices have been put into practice for the purpose of detecting the quantity of remaining developer in electrophotography.

SUMMARY OF THE INVENTION

It is a primary object of the present invention to provide an improved device for accurately and reliably detecting the quantity of powdered developer remaining within a tank for such powder.

It is another object of the present invention to provide an improved device of the described type which is simply constructed by utilizing the magnetism possessed by magnetic carrier usually included in powdered developer or the magnetism of toner itself.

Generally, the device for detecting the quantity of remaining developer according to the present invention may comprise a container for powdered developer formed of a non-magnetic material, and a magnet for producing a magnetic attraction between itself and the magnetism of the powdered developer. The magnetic attraction decreases with consumption of the powdered developer to thereby permit either the container or the magnet to be displaced. Such displacement opens or closes a switch in a remainder indicator circuit.

The invention will become more fully apparent from the following detailed description thereof taken in conjunction with the accompanying drawings.

DESCRIPTION OF THE PREFERRED EMBODIMENTS

Figure 1:
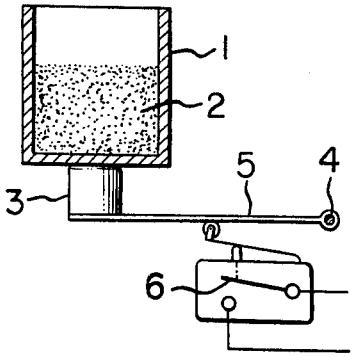
FIGS. 1 and 2 illustrate the principle of the detector device of the present invention.
Figure 2:
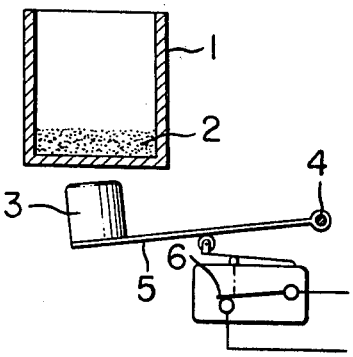

Referring to FIGS. 1 and 2, there is illustrated the principle underlying the device of the present invention. A supply container 1 is formed of non-magnetic material and contains therewithin powdered developer 2 possessing magnetism. A magnet 3 is attached to one end of a lever 5 supported for pivotal movement about a pin 4 on an apparatus body (not shown). Designated by 6 is a microswitch provided in a remainder indicator circuit (not shown).

When the supply container 1 filled with powdered developer 2 is mounted to the apparatus body, the magnetic attraction between the powdered developer 2 and the magnet 3 will cause the magnet 3 to pivot into intimate contact with the bottom of the supply container 1, whereby the microswitch 6 will be opened. The powdered developer 2 is supplied to a developing device (not shown) and, when the quantity of developer remaining in the supply container is decreased to a small amount, the magnetic attraction between the developer and the magnet 3 will be weaker to permit the magnet 3 to pivot down away from the supply container 1 due to gravity. This downward pivoting movement will cause the lever 5 to close the microswitch 6 and thus close the remainder indicator circuit, which in turn will energize alarm means such as lamp or bell to indicate that the powdered developer 2 within the supply container 1 has been reduced to a small amount.

Figure 3:
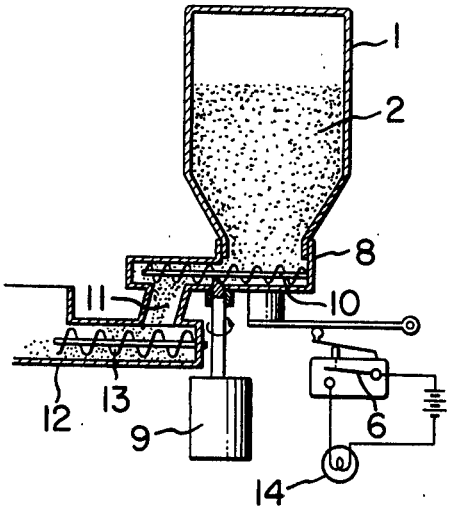
FIG. 3 is a front view, in vertical section, of a specific embodiment of the present invention.

FIG. 3 shows a specific embodiment of the device according to the present invention. The supply container 1 is mounted on a receptacle 8 with its open end facing downwardly. The powdered developer 2 drops into the receptacle 8, in which the developer may be moved toward an outlet 11 by the rotation of a screw roller 10 driven from a motor 9. The powdered developer 2 may drop through the outlet into a supply passage 12, through which the developer may be delivered toward the developing device by a screw roller 13.

In this manner the powdered developer 2 is supplied to the developing device and, when the supply container 1 becomes empty, with only a slight amount of developer remaining in the receptacle 8, the magnet 3 which has so far been maintained in intimate contact with the underside of the receptacle 8 by the magnetic attraction between the powdered developer 2 the the magnet 3 will now pivot away from the receptacle to close the microswitch 6 and turn on a lamp 14 in a remainder indicator circuit, thus indicating that the supply container 1 has become empty.

In the embodiment discussed above, the magnet 3 has been shown and described as being pivotally movable by the magnetic attraction between the powdered developer 2 and the magnet 3, but alternatively the magnet 3 may be stationary and the supply container may be movable.

Figure 5:
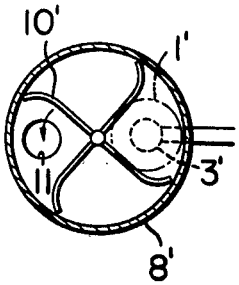
FIG. 5 is a transverse cross section taken along line IV—IV in FIG. 4.
Figure 4:
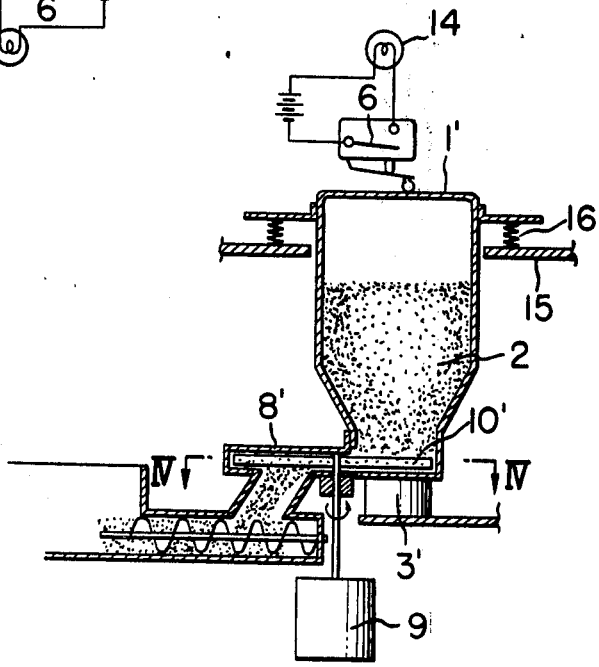
FIG. 4 is a view similar to FIG. 3 but showing another embodiment of the present invention.

FIG. 4 shows another embodiment of the present invention in which the magnet is stationary while the supply container is movable. A supply container 1' is disposed with its open end facing downwardly and rests on a spring 16 secured to a support 15 integral with the copying apparatus body (not shown). In this embodiment, the microswitch 6 is disposed above the supply container. When the quantity of the developer 2 present within the supply container 1' is above a predetermined level, gravity as well as the magnetic attraction between the powdered developer 2 and a magnet 3' fixedly supported to the apparatus body will maintain the container 1' in intimate contact with the magnet 3' against the spring action of the spring 16, so that the opening of the container 1' will closely fit to the entrance of a receptacle 8'. The developer within the supply container will be moved in the receptacle toward the outlet by a rotary impeller 10' driven from a motor 9. The powdered developer 2 is thus supplied to the developing device (not shown) and, when the supply container 1' has become empty with only a slight amount of developer remaining in the receptacle 8', the supply container 1', which has so far been maintained in contact with the magnet 3' by gravity and the magnetic force between the magnet 3' and the powdered developer 2, will now be moved upwardly by the spring force of the spring 16 until the top wall of the container closes the microswitch 6 to turn on a lamp 14 in the remainder indicator circuit, thus indicating that the supply container has become empty. The upward movement of the supply container 1' occurs when there is no magnetic attraction so that the vane of the impeller lies outside the cross section of the supply container 1' as shown in FIG. 5.

Thus, the present invention utilizes the magnetism of the powdered developer to detect the quantity of developer remaining in the supply container and this only involves a very simple construction to ensure that such detection is accomplished accurately.

I claim:

1. A device for detecting a decrease quantity of developer in a container comprising:

a non-magnetic stationary container for containing magnetic developer therewithin and having a lower discharge opening;

a magnet disposed outside and adjacent the bottom of said container for producing a magnetic attraction between the magnet and the developer within said container;

means for delivering the developer from said container through said opening thereof;

means for mounting said magnet for movement away from said container under the force of gravity when the developer is below a predetermined quantity; and a switch operable in response to movement of said magnet away from said container.

2. A device according to claim 1, wherein said means for delivering the developer is a rotary screw roller for moving the developer through said opening in the axial direction of said roller.

3. A device according to claim 1, wherein said means for delivering the developer is a rotary impeller for moving the developer through said opening in the direction of rotation of said rotary impeller.

4. A device for detecting a decreased quantity of developer in a container comprising:

a non-magnetic container for containing magnetic developer therewithin and having a lower discharge opening;

a magnet disposed outside and adjacent the bottom of said container for producing a magnetic attraction between the magnet and the developer within said container, wherein said magnet is stationary;

means for delivering the developer from said container through said opening thereof;

means for relatively moving said magnet and said container away from each other against said magnetic attraction when the developer is below a predetermined quantity, wherein said means for relatively moving said container and said magnet comprises a resilient member disposed to urge said container away from said magnet in response to a reduction in said magnetic attraction; and, a switch operable in response to movement of said container away from said magnet.

5. A device for detecting a decreased quantity of developer in a container comprising;

a fixedly mounted non-magnetic container for magnetic developer, said container having a discharge opening in a lower portion thereof;

means for delivering the developer from said container through said discharge opening;

a magnet disposed externally of said container and adjacent said lower portion thereof, said magnet being movably mounted for movement toward said container under a force of attraction between said magnet and the magnetic developer contained therein, and for movement away from said container, under the force of gravity when the magnetic developer is discharged therefrom through said opening; and means for sensing said movement of said magnet.

* * * * *

UNITED STATES PATENT OFFICE

CERTIFICATE OF CORRECTION

Patent No. 3,951,309 Dated APRIL 20, 1976

Inventor(s) SYUJIRO KADOWAKI

It is certified that error appears in the above-identified patent and that said Letters Patent are hereby corrected as shown below:

Column 1, line 67, delete "or" and insert --of--.

Column 2, line 1, change "som" to --some--.

Column 3, line 21, delete "the" (second occurrence) and insert --and--.

Column 4, line 4, change "decrease" to --decreased--.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*